US012601174B2

(12) United States Patent
Fivet et al.

(10) Patent No.: US 12,601,174 B2
(45) Date of Patent: Apr. 14, 2026

(54) LOAD BEARING DEVICE

(71) Applicant: ECOLE POLYTECHNIQUE FEDERALE DE LAUSANNE (EPFL), Lausanne (CH)

(72) Inventors: Corentin Fivet, Fribourg (CH); Dario Redaelli, Fribourg (CH); Alex-Manuel Muresan, Bern (CH); Jan Brutting, Fribourg (CH)

(73) Assignee: ECOLE POLYTECHNIQUE FEDERALE DE LAUSANNE (EPFL), Lausanne (CH)

( * ) Notice: Subject to any disclaimer, the term of this patent is extended or adjusted under 35 U.S.C. 154(b) by 96 days.

(21) Appl. No.: 17/772,420

(22) PCT Filed: Oct. 28, 2020

(86) PCT No.: PCT/EP2020/080271
§ 371 (c)(1),
(2) Date: Apr. 27, 2022

(87) PCT Pub. No.: WO2021/083952
PCT Pub. Date: May 6, 2021

(65) Prior Publication Data

US 2022/0389710 A1 Dec. 8, 2022

(30) Foreign Application Priority Data

Oct. 30, 2019 (EP) ..... 19206090

(51) Int. Cl.
*E04B 5/43* (2006.01)
*E04B 1/343* (2006.01)
*E04B 5/02* (2006.01)

(52) U.S. Cl.
CPC ..... *E04B 5/43* (2013.01); *E04B 1/34321* (2013.01); *E04C 2/50* (2013.01)

(58) Field of Classification Search
CPC ..... E04B 5/43; E04B 1/34321; E04C 2/50
(Continued)

(56) References Cited

U.S. PATENT DOCUMENTS 469,638 A * 2/1892 Chase ..... E04B 1/24 52/261
938,458 A * 11/1909 Brockhausen ..... E04B 5/43 52/432

(Continued)

FOREIGN PATENT DOCUMENTS

BR MU9100458 U2 * 5/2013
CN 101265723 A * 9/2008

(Continued)

OTHER PUBLICATIONS

International Search Report from corresponding PCT Application No. PCT/EP2020/080271 dated Jan. 26, 2021.

(Continued)

*Primary Examiner* — Brian D Mattei
*Assistant Examiner* — Joseph J. Sadlon
(74) *Attorney, Agent, or Firm* — Harness Dickey & Pierce P.L.C.

(57) ABSTRACT

The present relates to a device being used in modular building construction comprising at least one flat load support comprising a first main face and a second main face, at least one elongated load support designed for being coupled with said flat load support. The device is characterized in that said flat load support comprises an array of transverse openings extending through the thickness of the flat load support. The flat load support is arranged for fastening said flat load support with said elongated load support at any position corresponding to one of said opening in a reversible manner and to any position between said openings in a reversible manner. Each flat load support comprises revers- (Continued)

ible lateral connection means and/or reversible transversal connection means for coupling flat load supports in a reversible manner. The flat load support and the elongated load support are arranged for being detachably assembled to provide the modular, reversible, and/or versatile building construction. The invention further relates to a modular construction building based on said device and to a method using said device.

23 Claims, 8 Drawing Sheets

(58) Field of Classification Search
USPC ..... 52/282.1
See application file for complete search history.

(56) References Cited

U.S. PATENT DOCUMENTS 1,011,195 A * 12/1911 Harry ..... E04B 5/43 52/834
1,353,373 A * 9/1920 Allbright ..... E04B 5/43 52/320
2,199,152 A * 4/1940 Edge ..... E04B 1/168 52/634
3,036,356 A * 5/1962 Greulich ..... B28B 23/12 52/261
3,354,591 A * 11/1967 Buckminster ..... E04B 1/19 52/643
3,435,572 A * 4/1969 Fuchs ..... E04B 5/43 52/251
3,500,601 A * 3/1970 Hamill ..... E04B 1/185 52/263
3,613,325 A * 10/1971 Yee ..... E04B 1/20 52/236.8
3,633,325 A * 1/1972 Bartoli ..... E04B 1/3412 52/246
3,727,362 A * 4/1973 Ellison ..... E04B 5/14 52/645
3,733,762 A * 5/1973 Pardo ..... E04B 5/43 52/319
3,780,480 A * 12/1973 Cvijanovic ..... E04B 1/215 52/587.1
3,822,519 A * 7/1974 Antoniou ..... E04B 1/3483 52/79.13
3,824,750 A * 7/1974 Antoniou ..... E04B 1/3483 52/223.4
3,927,499 A * 12/1975 Papayoti ..... E04B 5/43 52/654.1
4,024,687 A * 5/1977 Kozak ..... E04B 1/04 52/262
4,033,081 A * 7/1977 Perkins, Jr. ..... E04B 1/12 411/921
4,038,126 A * 7/1977 Lester ..... A47B 13/023 156/290
4,096,675 A * 6/1978 Howard ..... E04B 1/35 52/143
4,098,039 A * 7/1978 Sutelan ..... E04H 1/04 52/73
4,288,963 A * 9/1981 van der Meulen ..... E04B 1/35 264/32
4,521,998 A * 6/1985 DeLorme ..... E04B 1/1903 52/81.3
4,545,169 A * 10/1985 Rizk ..... E04B 1/3483 52/234
4,573,302 A * 3/1986 Caretto ..... E04B 1/35 52/741.15
4,575,978 A * 3/1986 Huhn ..... E04B 1/18 52/234
4,575,984 A * 3/1986 Versteeg ..... E01C 5/08 52/591.2
4,671,693 A * 6/1987 Rossman ..... E04B 1/1909 52/81.3
4,736,557 A * 4/1988 Maryon ..... E04H 1/00 52/30
4,751,803 A * 6/1988 Zimmerman ..... B28B 19/003 52/414
4,807,418 A * 2/1989 Ferguson ..... E04B 1/0007 52/169.4
4,904,108 A * 2/1990 Wendel ..... E04B 1/1912 403/356
5,031,371 A * 7/1991 Davister ..... E04B 1/1909 52/236.1
5,090,172 A * 2/1992 Chana ..... E04C 5/0645 52/252
5,181,359 A * 1/1993 Chana ..... E04B 5/43 52/250
5,289,665 A * 3/1994 Higgins ..... E04B 5/43 52/655.1
5,333,423 A * 8/1994 Propst ..... E04F 15/02476 248/188
5,507,124 A * 4/1996 Tadros ..... E04B 5/43 52/251
5,553,430 A * 9/1996 Majnaric ..... E01D 11/00 52/428
5,640,821 A * 6/1997 Koch ..... A47F 5/16 52/630
5,704,174 A * 1/1998 Dal Lago ..... E04B 5/04 52/223.6
5,787,663 A * 8/1998 Wehrmann ..... E04B 5/14 52/645
5,904,021 A * 5/1999 Fisher ..... E04F 15/082 52/177
5,934,036 A * 8/1999 Gallagher, Jr. ..... E04B 5/36 249/188
5,937,602 A * 8/1999 Jalbert ..... E01C 11/14 404/37
6,134,860 A * 10/2000 Pagano ..... E04B 1/35 52/745.1
6,266,938 B1 * 7/2001 Sheu ..... E04B 5/14 248/676
6,385,930 B1 * 5/2002 Broms ..... E04B 5/43 52/223.6
6,519,902 B1 * 2/2003 Scissom ..... E04F 15/02405 52/630
6,625,937 B1 * 9/2003 Parker ..... E04H 1/02 52/79.9
6,625,943 B1 * 9/2003 Renner ..... E04B 5/12 52/319
6,640,513 B2 * 11/2003 Ku ..... E04F 15/02 52/177
6,832,455 B1 * 12/2004 Tomlinson ..... E04B 1/20 52/745.07
6,920,728 B2 * 7/2005 Powers ..... E04C 3/34 52/250
7,121,061 B2 * 10/2006 Jazzar ..... E04B 1/164 52/236.8
7,310,920 B2 * 12/2007 Hovey, Jr. ..... E04B 1/24 52/656.1
7,360,343 B1 * 4/2008 Spransy ..... E04F 15/02458 52/480
7,373,759 B1 * 5/2008 Simmons ..... E04F 15/024 52/126.2
7,448,400 B2 * 11/2008 Jensen ..... E04H 15/18 52/63
7,520,014 B2 * 4/2009 Homsi ..... E01D 19/103 14/77.3
7,540,354 B2 * 6/2009 Morin ..... F02K 1/827 428/116
7,634,888 B2 * 12/2009 Cloyd ..... E04C 3/42 52/693
7,669,272 B2 * 3/2010 Powers ..... E01D 21/06 14/77.1
7,882,665 B2 * 2/2011 Kawai ..... E04B 1/24 52/261
7,900,416 B1 * 3/2011 Yokubison ..... E04F 15/087 52/592.1
7,946,086 B2 * 5/2011 Hammer ..... E04C 5/08 52/223.5

(56) References Cited

U.S. PATENT DOCUMENTS 7,980,040 B2 * 7/2011 Pacione ..... E04B 1/28 52/584.1
8,011,147 B2 * 9/2011 Hanlan ..... E04B 5/04 52/283
8,011,156 B1 * 9/2011 Schwan ..... A63H 33/088 52/655.1
8,110,134 B2 * 2/2012 Scott ..... B28B 7/24 249/126
8,322,115 B2 * 12/2012 Foell ..... E04B 2/86 52/745.1
8,505,267 B2 * 8/2013 Martin Hernandez ... E04B 5/43 52/749.11
8,549,805 B2 * 10/2013 Kim ..... E04B 5/43 52/745.18
8,627,632 B2 * 1/2014 Werner ..... B21C 23/10 52/653.1
8,671,634 B2 * 3/2014 Morcous ..... E04B 5/43 52/258
8,701,357 B2 * 4/2014 Kovel ..... E04B 1/00 52/236.4
8,720,154 B1 * 5/2014 Horne ..... E04B 7/045 52/262
8,752,347 B2 * 6/2014 Keller ..... E04C 5/00 52/309.13
8,844,238 B2 * 9/2014 Baldoni ..... E04C 5/168 52/645
8,881,482 B2 * 11/2014 Cerny ..... E01C 13/045 52/126.5
9,091,049 B2 * 7/2015 Walker ..... E04C 2/38
9,169,643 B2 * 10/2015 Dryburgh ..... B28B 7/0014
9,206,595 B2 * 12/2015 Rutledge ..... E04B 1/34315
9,228,345 B2 * 1/2016 Weber ..... E04B 1/19
9,255,404 B2 * 2/2016 Willems ..... B28B 1/16
9,366,020 B2 * 6/2016 Farnsworth ..... E04H 1/04
9,388,562 B2 * 7/2016 Thomas ..... E04B 1/04
9,562,353 B2 * 2/2017 Bettiol ..... E04B 1/12
9,604,428 B2 * 3/2017 Walker ..... B29D 28/00
9,617,725 B2 * 4/2017 Carless ..... E04C 2/521
9,631,385 B1 * 4/2017 Phillips ..... E04C 2/44
9,683,361 B2 * 6/2017 Timberlake ..... E04B 1/167
9,920,490 B2 * 3/2018 Sylvester ..... E01C 5/08
10,094,101 B1 * 10/2018 Jazzar ..... E04C 3/34
10,125,457 B1 * 11/2018 Yin ..... E01D 19/125
10,145,130 B1 * 12/2018 Yin ..... E04B 5/18
10,246,869 B1 * 4/2019 Toothman ..... E02D 27/016
10,316,509 B2 * 6/2019 Jackson ..... E04B 1/2403
10,538,905 B2 * 1/2020 Pirrung ..... E04B 5/02
10,557,264 B2 * 2/2020 Zavitz ..... E04C 3/293
10,577,793 B2 * 3/2020 Cohen ..... E04B 1/1909
10,584,503 B2 * 3/2020 Fan ..... E04B 1/34315
10,648,167 B2 * 5/2020 Satchell ..... E04B 5/10
10,688,906 B2 * 6/2020 Tiramani ..... E04B 1/3442
10,718,107 B2 * 7/2020 Martin ..... E04B 1/19
10,760,260 B2 * 9/2020 Yin ..... E04B 1/04
10,829,932 B2 * 11/2020 Wennberg ..... A63H 33/062
10,883,264 B1 * 1/2021 Wee ..... B29D 99/0021
10,883,648 B2 * 1/2021 Notohardjono ..... F16M 11/22
10,941,560 B2 * 3/2021 DiTrolio ..... A47H 1/02
11,236,501 B2 * 2/2022 Boyd ..... E04B 1/24
11,339,562 B2 * 5/2022 Heidenreich ..... E04B 1/32
11,578,486 B2 * 2/2023 Lang ..... E04C 2/12
11,598,066 B2 * 3/2023 Lim ..... E02D 27/01
11,619,041 B2 * 4/2023 Mullaney ..... E04B 1/34326 52/79.1
11,674,300 B2 * 6/2023 Maderebner ..... E04B 5/12 403/174
12,077,962 B2 * 9/2024 Fernandez Herrero ... B32B 3/12
2001/0003234 A1 * 6/2001 Van Doren ..... E04B 1/165 52/250
2003/0097806 A1 * 5/2003 Brown ..... E04B 5/48 52/220.1
2005/0115187 A1 * 6/2005 Sunahara ..... E04B 5/32 52/633
2005/0138867 A1 * 6/2005 Zhao ..... A01G 9/14 52/79.1
2010/0107520 A1 * 5/2010 Lundmark ..... E04B 1/20 52/573.1
2011/0167758 A1 * 7/2011 Daadoush ..... E04B 1/3483 403/345
2014/0041328 A1 * 2/2014 Stehle ..... E04B 5/19 52/250
2016/0032581 A1 * 2/2016 Sklar ..... E04C 3/122 52/220.8
2016/0251853 A1 * 9/2016 Rubel ..... E04B 5/04 52/745.13
2016/0348368 A1 * 12/2016 Godfrey ..... E04B 1/10
2019/0055731 A1 * 2/2019 Nasibov ..... E04C 2/292
2023/0203818 A1 * 6/2023 Gori ..... E04D 13/076 52/12

FOREIGN PATENT DOCUMENTS

EP 1370736 B2 * 7/2013 ..... E04G 1/154
EP 2937483 A1 * 10/2015 ..... E04B 1/86
ES 2362367 T3 * 7/2011 ..... E04B 5/29
FR 1174724 A * 3/1959 ..... E04B 1/2403
IT 1119199 B * 3/1986 ..... E04C 2/365
JP H09328818 A * 12/1997 ..... E04F 17/08
JP 2013124454 A * 6/2013
KR 101050167 B1 7/2011
NL 8503110 A * 6/1987 ..... E04B 1/04
WO WO-2004099515 A1 11/2004
WO WO-2015044204 A1 * 4/2015 ..... E04B 1/34321

OTHER PUBLICATIONS

Written Opinion from corresponding PCT Application No. PCT/EP2020/080271 dated Jan. 26, 2021.

* cited by examiner

LOAD BEARING DEVICE

PRIORITY STATEMENT

This application is a national stage application under 35 U.S.C. § 371 of PCT International Application No. PCT/EP2020/080271, which has an international filing date of 28 Oct. 2020 and claims priority under 35 U.S.C. § 119 to European Patent Application No. 19206090.3 filed on 30 Oct. 2019. The contents of each application recited above are incorporated herein by reference in their entirety.

TECHNICAL FIELD

The present invention relates to a load-bearing device and to a building comprising said device. The invention also concerns a method for constructing buildings comprising said load-bearing device.

BACKGROUND OF THE ART

Prefabricated modular flooring or roofing systems are known and frequently used to construct buildings used in temporary event.

For instance, the document US20020092249 describes a partially prefabricated waffle slab. The slabs are identical square components coupled side by side to assemble a floor. The assembled floor is maintained by pillars fixed on the periphery of the floor. Each slab comprises nine cavities fulfilled with reinforced concrete upon assembly to strength the floor.

The document U.S. Pat. No. 3,918,222 discloses a prefabricated flooring and roofing system designed for being used for supporting a machine or in a building construction. The system comprises a plurality of elongated precast concrete slabs forming a waffle-type floor structure. The slabs are positioned side by side to fulfil the space defined by a steel frame structure to construct the floor or roof.

Despite current efforts, the environmental footprint of the construction industry remains an urgent concern, in particular regarding construction of temporary event buildings. Ever-increasing urban densification and ever-changing functional/architectural requirements too often lead to the premature demolition of load-bearing systems, although their elements still fulfil strength and serviceability requirements. Various approaches have been developed to tackle this issue.

Architects and structural engineers efforts to remediate those issues traditionally consist in minimizing material quantities and using low-impact materials.

Another strategy has recently been re-introduced: the reuse of structural components over multiple service lives and in other systems.

However, when it comes to reuse structural components, existing technologies do not provide satisfying solutions notably because they lack modularity, i.e. sets of components can only be assembled in a small number of variants. In other words, the range of reusability very much depends on the original construction plan, the second or "n" uses of the components is conditioned by the first use which drastically limits the possibility to reuse the components for future uses.

SUMMARY OF THE INVENTION

The above problems are solved at least partially by the device and the method according to present invention.

The invention concerns a load bearing device for being used in modular, reversible, and/or versatile building construction, the device comprising:

- at least one flat load support comprising a first main face and a second main face opposed to the first main face, the first face and the second main face being connected by a lateral face, the distance between the first main face and the second main face defining the thickness of the flat load support,
- at least one elongated load support designed for being coupled with said flat load support;

the device being characterized in that

- said flat load support comprises an array of traverse openings, each opening extending through the thickness of the flat load support,
- the device further comprising reversible fastening means arranged for fastening said flat load support with said elongated load support at any position corresponding to one of said opening in a reversible manner and to any position between said openings in a reversible manner,
- wherein each flat load support comprises reversible lateral connection means on the lateral face so as to couple at least two flat load supports side by side in a reversible manner, and/or each flat load support comprises reversible transversal connection means for coupling two superimposed flat load supports in a reversible manner, so that said flat load support and said elongated load support are arranged for being detachably assembled to provide the modular, reversible, and/or versatile building construction.

Advantageously, the device comprises an array of openings, and each of said opening or any position between said openings is arranged for being fastened with an elongated support. In other words, there are two types of possible locations on the flat load support for fastening the elongated load support (via fastening means): firstly each opening is a possible location for fastening an elongated load support, and secondly any position between said opening is also a possible location for an elongated load support. The existing prior art does not permit these two possible locations.

The present invention provides a highly versatile device because the elongated load support can be coupled with any one of openings or any position between said openings contrary to the prior art, notably US20020092249, where the elongated load support can solely be fixed on the corners of the slab element.

The present invention further comprises reversible fastening means for fastening one opening or any position between said openings with one elongated load support. Thus, one elongated support can be fastened and unfastened to an opening or any position between said openings (and thus to a flat load support) without damages. For instance, the user can fasten one elongated load support to a first opening or to a first position between said openings, unfasten them, and fasten the same elongated load support to a second opening different from the first opening/position or identical to the first one, and so on.

The present invention offers an open-ended reusability. Each opening or any position between said openings in the flat load support, for instance a slab element, is a possible location for elongated load support, for instance columns and vertical shafts, allowing for adaptable and flexible floor plans.

Advantageously, the present invention favors prefabrication of the components and generates no waste on site: after reassembly, unused elements are kept to a minimum because the number of different element types is very small.

By putting environmental aspects and open-ended reusability at the core of the design problem, the present invention is unique in the way it can adapt to unpredictable, long-term changes of functional requirements.

The present invention is original in that it meets and exceeds all requirements for (re)usability: durability, versatility, modularity, reversibility, and transformability. Embedding the conditions for a circular economy, it has the potential to radically transform the construction field from a market based on construction/demolition of the structural skeleton to a market based on the rearrangement/relocation of structural modules.

The present invention is a unique solution to reduce the environmental footprint of the building sector. Because it allows a highly versatile reuse of its elements, its application to market has the potential to reduce greenhouse gas emissions and waste related to building construction and demolition.

Preferably, the present invention is designed for being used for office and housing buildings, low-rise to high-rise office or apartment buildings, for instance temporary office and housing buildings such as those needed for recurring international sport events.

Advantageously, in the present invention the span between elongated load supports is not restrained to a multiple of any element length since the elongated load support can be fastened with any of the opening or any position between said openings of the flat load support.

Advantageously, each flat load support comprises reversible connection means for connecting two flat load supports together, for instance reversible lateral connection means, and/or reversible transversal connection means. Preferably, the connection means are easily operated with a minimum or simple tools. For instance, the connection means are chosen among bolted connections, interlocking assemblies, or face-to-face assemblies.

In the present invention, the device further comprises reversible fastening means so that said flat load support is arranged for being fastened with said elongated load support in a reversible manner.

The opening is preferably involved in the reversible connection. In an embodiment, each opening is arranged for being fastened with said elongated load support in a reversible manner. For instance, the elongated load support is at least partially received within said opening.

Alternatively, any position between said openings can be involved in the reversible connection. In other words, any portion of the first main face or second main face between said openings can be involved in the reversible connection.

In one embodiment, said lateral faces are arranged for being fastened with said elongated load support in a reversible manner.

In an embodiment, each opening is delimited by sides arranged for being fastened or coupled with or connected to said elongated load support in a reversible manner. For instance, the elongated load support is fastened or connected or coupled to the sides of the opening between the first main face and the second main face of the flat load support. For example, the elongated load support is fastened to the side separating adjacent openings.

In a particular embodiment, the flat load support and the elongated load support are orthogonal.

In a preferred embodiment, the flat load support and connections resist forces in all directions.

In a particular embodiment, structural stiffness and strength are uniform in the plane of the flat load support and symmetric in the transverse plane.

In an embodiment, the flat load support is a slab element. Preferably, the present invention consists in identical, interchangeable perforated slab elements that can be freely connected (a) in the plane to produce new floor outlines, and (b) in layers to adjust static height with new spans between elongated load supports.

According to an embodiment, each flat load support is configured to be superimposed on top of each other, preferably the device comprising at least two flat load support superimposed. Superimposing flat load support directly allows to adjust the static height and/or the local stiffness of a floor. Advantageously, this allows to further increase the flexibility and the modularity of the present invention depending on the needs, constraints, or requirements to be met by the load bearing device. It is possible to adjust on one hand the position of the elongated load support fastened to the flat load support and on the other hand the number of superimposed flat load supports to arrive at the required thickness (overlap).

The flat load support can be of various shape, for instance square, rectangle, triangle, or any shape allowing tessellation.

The flat load support can be of various sizes, e.g. square flat load support of dimensions a×a, a/2×a/2, a×2a, 3a/2×3a where a is the determining length, for instance comprised between 1.00 m to 5.00 m, preferably between 2.00 m to 3.00 m, for instance 2.40 meters.

In a particular embodiment, the lateral side of the flat load support is discontinued by openings.

In another particular embodiment, the lateral side of the flat load support is continuous and fully encloses all openings.

According to an embodiment, the stiffness and strength of the flat load supports, the number of elongated load supports fastened to the flat load supports, and/or the number of flat load supports superimposed are tuned with one another. In a preferred embodiment, the spatial distribution of the stiffness of the flat load support is tuned by locally superimposing a determined number of flat load supports. This allows to increase the flat load support stiffness, for instance locally, to meet special load resistance requirements of said portion, for instance to fulfil strength and serviceability requirements without oversizing any individual flat load support.

According to an embodiment, the elongated load support is a column comprising at least one distal end designed for being fastened with said elongated load support at any position corresponding to one of said openings and/or to any position between said openings in a reversible manner.

In a preferred embodiment, two superimposed elongated load supports are fastened together and run through one of said openings. This allows to transfer forces between columns independently of the flat load support. In a preferred embodiment, each elongated load support is fastened to a flat load support. This allows to transfer forces from said flat load supports to said elongated load supports.

Preferably, the cross section of the distal end of the elongated load support, for instance a shaft or a column, is shaped to fit into the opening. In other words, the cross section of the elongated load support, designed for being received in the opening, and the opening have complementary shape. This allows the placement or removal of any of said elongated load support or any of said flat load support, either from underneath or from above the flat load support. The elongated load support can be of various external shape, for instance square, circle, triangle or polygonal. That shape does not have to be constant along the elongated load support or equal between multiple stacked elongated load supports.

Preferably, each opening is arranged for receiving either an elongated load support or service shaft. Thus each opening is arranged for alternating between two functions, i.e. receiving an elongated load support or a service shaft. This allows the positioning of shafts and columns to be swapped or moved at any other opening. The opening is also a support for a tile.

In an embodiment, the device further comprises at least one connector for connecting the elongated load support with the flat load support at any position corresponding to one of said opening and/or to any position between said openings. This allows the fixation or removal of the elongated load support. In a particular embodiment, the connector is monobloc, in other words integral. In a preferred embodiment, the connector is constituted by a plurality of elements integral with each other.

Preferably, the connector is shaped to fit into the opening or any position between said openings. In particular, the length of the connector along the longitudinal axis of the elongated load support is determined to match the thickness of the opening. In particular, the cross section of the connector is determined to fit within the opening. This allows the placement or removal of the connector from beneath or from above the flat load support.

Preferably, the connector is arranged for resisting and transferring forces between the flat load support and the elongated load support. This allows the supports to resist as a system.

According to an embodiment, the fastening means are chosen among tenon mortise, bolts, interlocking, or any other reversible fastening mean. This allows the multiple assembly and reassembly of any one or more of said flat load support and elongated load support.

In a preferred embodiment, the fastening means are shared between the flat load support and the elongated load support: each opening is delimited by an edge, the elongated load support comprising a shoulder accommodated on one of the distal end, said shoulder being arranged for contacting said edge to fasten said elongated load support with said opening. This allows a better distribution of loads from said flat load support to said elongated load support.

In an embodiment, at least some of, preferably each of, the openings are arranged for receiving service shaft, for instance water tube or air tube. This allows the service shafts to be placed in any position.

In an embodiment, the openings are distributed evenly on the network of flat load supports. This allows the rationalization of the prefabrication of the components. It also allows the positioning of the vertical shafts on a regular grid.

The openings of the load support can be of various shape, for instance square, circle, triangle and polygon. They can also be of various sizes.

According to an embodiment, each flat load support comprises reversible lateral connection means on the lateral face to fix at least two flat load supports side by side. Thus the present invention allows to modulate the dimension and shape of the device in the plan, named in a 2D plane (X,Y), by modulating the number and positions of flat load support side by side.

Preferably, the reversible lateral connection means are configured so that all the openings of the flat load support laterally connected remain aligned on a continuous grid of axes. It allows the grid of openings of the device to be defined independently of the way flat load supports are laterally connected.

In a preferred embodiment, the lateral connection means are arranged for transferring forces between the flat load supports that are side by side, in particular shear forces, bending moments, torsion, and axial forces, such as compression and traction forces in XY-plane.

In an embodiment, each flat load support comprises reversible transversal connection means for fixing two superimposed flat load supports. Thus the present invention allow to modulate the dimension of the device in a 3D space (x,y,z) by modulating the number of superimposed flat load supports. This allows the strengthening and stiffening of existing devices by adding new flat load supports locally. It also allows the reduction of needed material volume by removing flat load supports locally.

In a preferred embodiment, the transversal connection means are arranged for transferring forces between the flat load supports that are superimposed. It allows the superimposed flat load supports to resist as one integral system.

Preferably, the reversible transversal connection means are configured so that all the openings of the flat load support transversally connected remain aligned. In other words, each opening leads to another opening. This prevents existing openings from being obstructed by new superimpositions.

In a particular embodiment, the openings of connected flat load supports, either laterally or transversally, are aligned on a continuous grid of axes. It is possible to have an offset between flat load supports, while openings remain aligned on a continuous grid of axes.

In an embodiment, the device further comprises at least one tile, i.e. tile element, designed for covering at least one opening. Each opening in the flat load support is a possible location for an elongated load support. At least a portion of the remaining openings or all the remaining openings can be covered with tiles providing for instance a modular, custom finishing for a floor made with said flat load supports.

Preferably, the tile allows to provide a plane surface on the flat load support.

In a particular embodiment, the tile transfers loads applied to it to the flat load support.

In a particular embodiment, each tile covers more than one opening.

In a preferred embodiment, the material composition of the tile is chosen depending on the feature of the portion of the flat load support on which said tile is fixed. For instance, the material composition of the tile is chosen among fireproof or fire retardant material, used as acoustic insulator against impact and/or airborne sound, or used as thermal insulator.

In a particular embodiment, a flat load support is covered by tiles made with different types such that the user can modulate the features of the flat load support locally.

In a particular embodiment, each tile is arranged for being replaceable independently from the flat load support. This is particularly advantageous if the lifetime of the tile is inferior to the one of the flat load support.

In an embodiment, the device comprises at least two flat load supports substantially parallel and connected to at least one elongated load support. In a preferred embodiment, the connections between the said at least two flat load supports and the elongated load support are reversible. In a preferred embodiment, the connections between the said at least two flat load supports and the elongated load support transfer forces from one to the other.

In an embodiment, the number of elongated load supports per flat load support and/or their position is adjusted to provide at least one flat load support with a predetermined load bearing resistance or stiffness.

In an embodiment, a plurality of flat load supports is connected together according to a distribution depending on the number and positions of elongated load supports. This allows to achieve tailored distributions of strength and stiffness for given load cases. In a preferred embodiment, the flat load supports are removed or added or rearranged on an individual basis. This allows to achieve tailored distributions of strength and stiffness for new load cases without a global rearrangement of the supports configuration.

In an embodiment, the material of the flat load support is chosen among reinforced concrete, metal for instance steel or aluminum, glue laminated timber, and whole timber or as a combination of the former.

In a particular embodiment, each elongated load support is replaceable independently.

In a preferred embodiment, each flat load support is replaceable independently.

The invention also concerns a construction building comprising at least one device according to the invention.

The particular advantages of the construction building are similar to the ones of the device of the invention and will thus not be repeated here.

The invention also relates to method for constructing modular, reversible and/or versatile buildings comprising a load bearing device, the method comprising:

i) providing a load bearing device according to the present invention;

ii) assembling at least one flat load support and at least one elongated load support, preferably at least two or three elongated load supports, according to a first construction plan to provide a first building 100 (See example embodiment of FIG. 5A);

iii) disassembling the first modular building 100 by unfastening the fastening means that fasten said at least one flat load support and said elongated load support;

iv) re assembling at least some of said at least one flat load support and at least some of said elongated load support according to a second construction plan different from said first construction plan to provide a second building 200 different from said first building 100 or identical to said first building 100;

The present invention allows to build several buildings, named diverse configurations of buildings, with the same flat load support(s) and the same elongated load support(s) or at least some of said flat load support and at least some of said elongated load support, or in combination with other elements.

Preferably, during the disassembly step, if flat load supports are superimposed and fastened together, they should also be disassembled.

The present invention also allows building a first building, disassembling it and reassembling the identical first building.

Since it combines reversibility with versatility, the present invention is particularly well suited to be reused over multiple life cycles, even if the future uses are not identified at the time of manufacturing. The reused stock of elements, for instance flat and elongated load supports or connection means, is generated from one or multiple buildings, previously located on the same location or not, previously laid out in the same spatial configurations or not.

The particular advantages of the method are similar to the ones of the device and of the modular construction building of the invention and will thus not be repeated here.

In one embodiment, the method further comprises:

iv) repeating step ii) to iv) to build a «n» building according to a «n» construction plan.

In this embodiment, "n" designates a first second, third etc building assembled according to a corresponding first, second, third etc construction plan.

In one embodiment, the method comprises:

1) Installing at least one tile on one of said opening;

2)a) Removing or replacing or placing said tile) to fit new layouts of elongated load support fastened to the flat load support and/or to fit to new service shaft;

Or 2)b) Removing said tiles during the disassembly of said first building; and re installing said tiles during the re-assembly of the first building or the second building;

In an embodiment, the method comprises:

Installing at least one tile on one of said opening during the assembly of the first building;

Removing said tiles without disassembling said first building;

Re-installing said tiles in the first building to adapt to new layouts of elongated load support fastened to the flat load support and/or to fit to new service shaft.

In one embodiment, the method comprises:

assembling at least two flat load supports on top of each other;

In the present invention, the terms "load bearing device" designate a device capable of bearing a load, said device being used for constructing a building, for instance a modular building, or other platforms and covers used to host activities or objects.

In the present invention, the terms "flat load support" designate a flat or substantially flat element in a 2D plane designed for providing a load bearing resistance when a load acts on it. For instance, the flat load support is a slab element or a slab or another element used to assemble a floor.

In the present invention, the terms "elongated load support" designate an element extending longitudinally and capable of supporting at least normal forces along its longitudinal axis. For instance, an elongated load support is a shaft for load bearing, for instance a post or a column. On one end, the elongated load support is coupled to an opening or a face of a flat load support. On the opposite end, the elongated load support is for instance coupled to another opening, or to another face of a flat load support, or to another elongated load support, or to the ground, or to another floor, or to the foundation of the building.

The embodiments described for the device also apply to the method and to the modular building construction according to the present invention mutatis mutandis.

BRIEF DESCRIPTION OF THE DRAWINGS

Further particular advantages and features of the invention will become more apparent from the following non-limitative description of at least one embodiment of the invention which will refer to the accompanying drawings, wherein.

DETAILED DESCRIPTION OF THE INVENTION

The present detailed description is intended to illustrate the invention in a non-limitative manner since any feature of an embodiment may be combined with any other feature of a different embodiment in an advantageous manner.

FIGS. 1 to 4 represent various embodiments of the present invention, but the invention is not limited to the represented embodiment.

Figure 1:
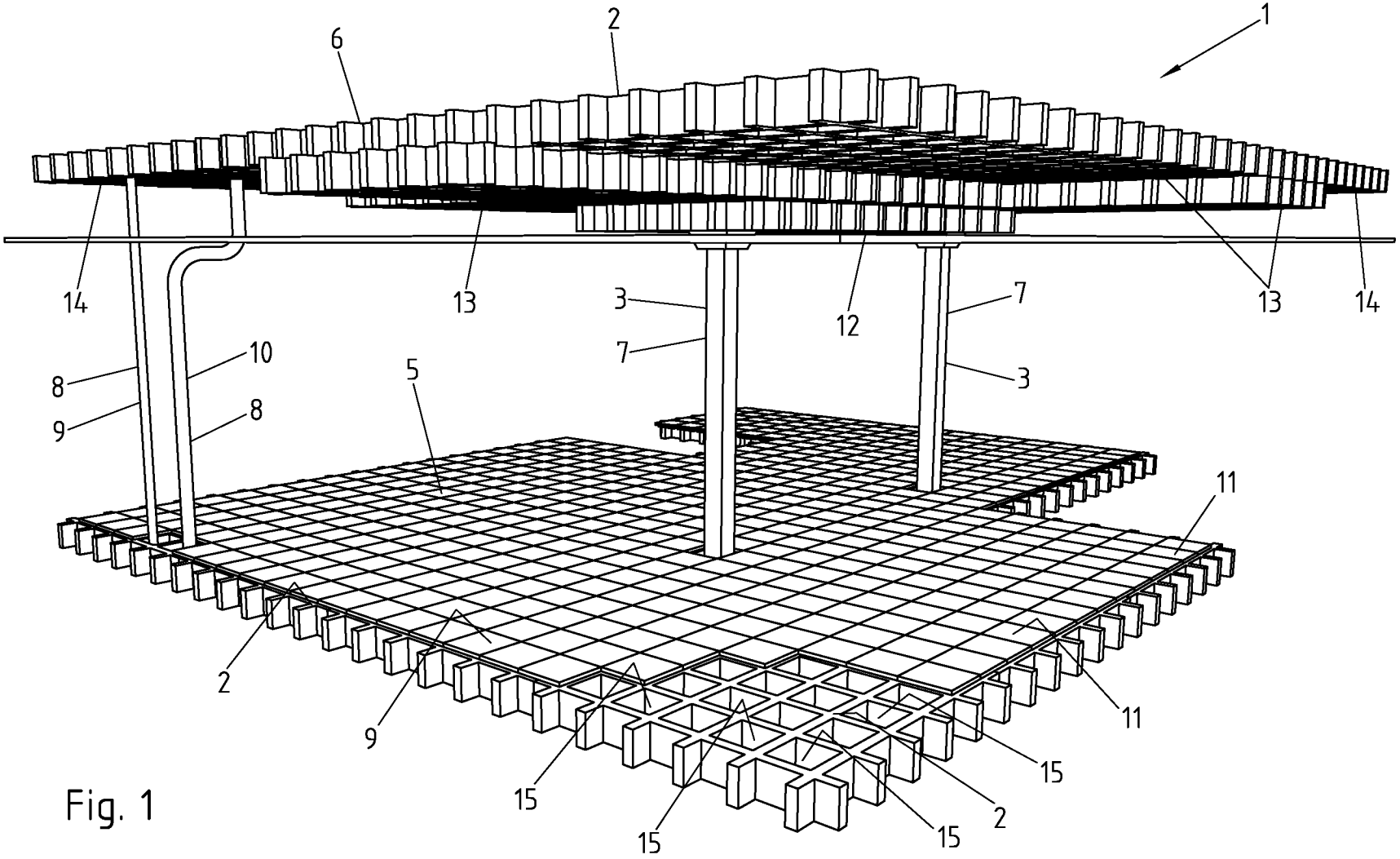
FIG. 1 illustrates a first embodiment of device according to the invention.

FIG. 1 represents a device 1 comprising two flat load supports 2 and two elongated load supports 3. In the present embodiment, the flat load support 2 is an assembly of slab elements 4. In the present case, the slab elements 4 are assembled to constitute a floor 5 and a ceiling 6.

The elongated load supports 3 are constituted by columns 7. The device 1 further comprises two service shafts 8 namely a water tube 9 and a technical shaft 10.

A portion of the slab element 4 of the floor 5 are covered by tiles 11.

In the present embodiment, a first portion 12 of the ceiling 6 is constituted by three slab elements superimposed, a second portion 13 is constituted by two slab elements 4 superimposed, while the remaining third portion 14 comprises only one slab element 4. Thus, the ceiling 6 presents a variable stiffness depending on the number of superimposed slab element 4.

In the embodiment represented in FIGS. 1 to 4, each slab element 4 has a square shape with an array of square openings 15 distributed evenly.

Each slab element 4 comprises a first main face 16 and a second main face 17 opposite the first main face 16. The first main face 16 and the second main face 17 are connected by a lateral face 18 defining the thickness of the slab element 4. In the present embodiment, the lateral face 18 is cut through the openings 15.

The slab element 4 is square "a*a" (length*width) with "a" chosen as 2.40 m for this embodiment.

The slab element 4 comprises reversible connection means for connecting slab elements laterally and transversally. To that end, the slab element 4 comprises reversible lateral connection means 19 and reversible transversal connection means 20.

Figure 2A:
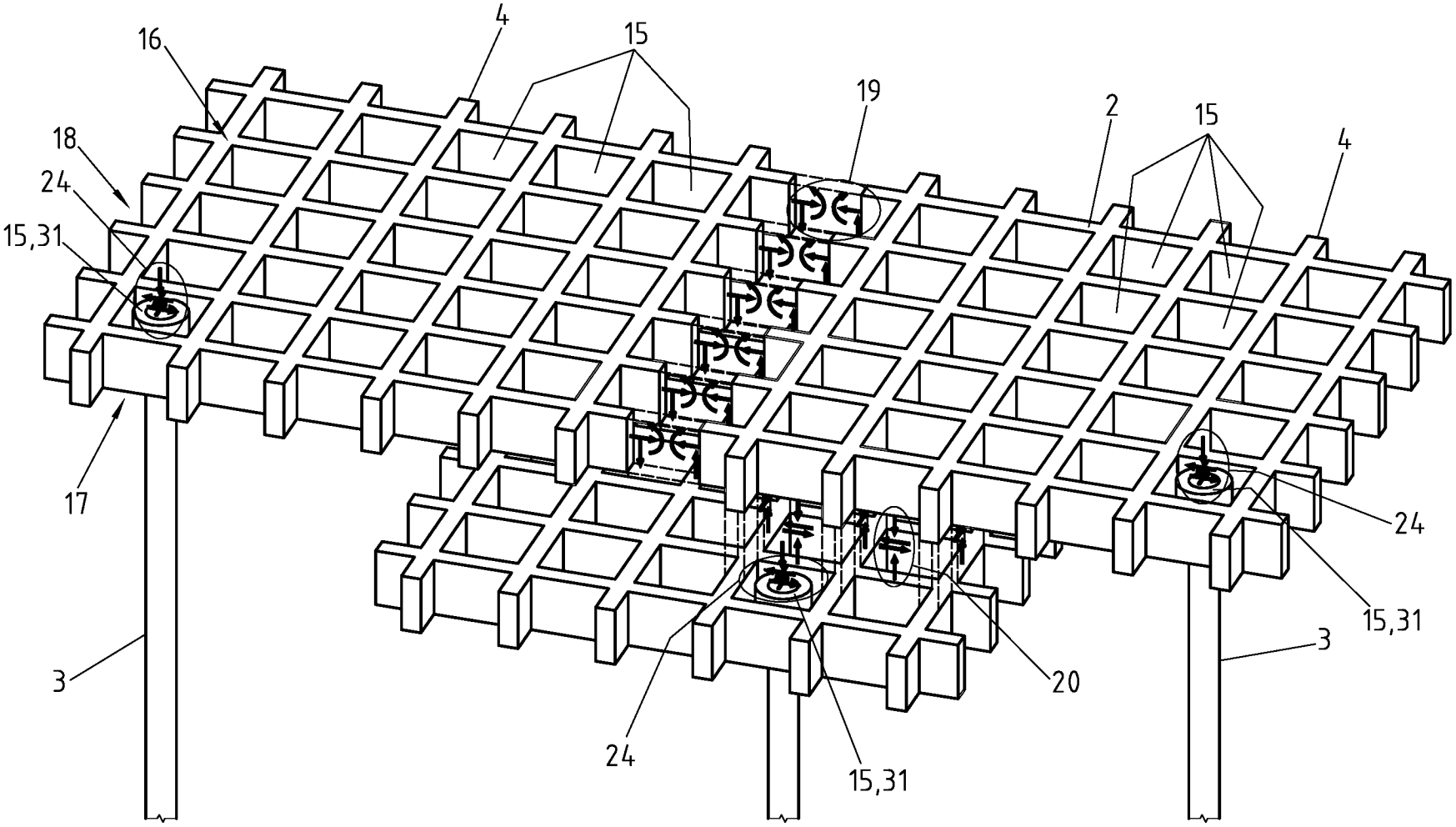
FIGS. 2*a-c* illustrate three general schemes representing a flat load support with three slab elements and three elongated load supports where the position of the elongated load supports relative to the flat load supports varies.

FIG. 2*a* is a general scheme representing a flat load support 2 with three slab elements 4 and three column 7 (i.e. elongated load support 3). Two slab elements 4 are side by side and connected by reversible lateral connection means 19. One slab element 4 is superimposed to the other two slab elements 4 and connected with said slab element 4 by reversible transversal connection means 20. In this embodiment, the columns 7 (i.e. elongated load supports 3) are fastened with the slab 4 (i.e. flat load supports 2) at positions 31 corresponding to the openings 15 of said slab 4 (i.e. flat load supports 2).

Figure 2B:
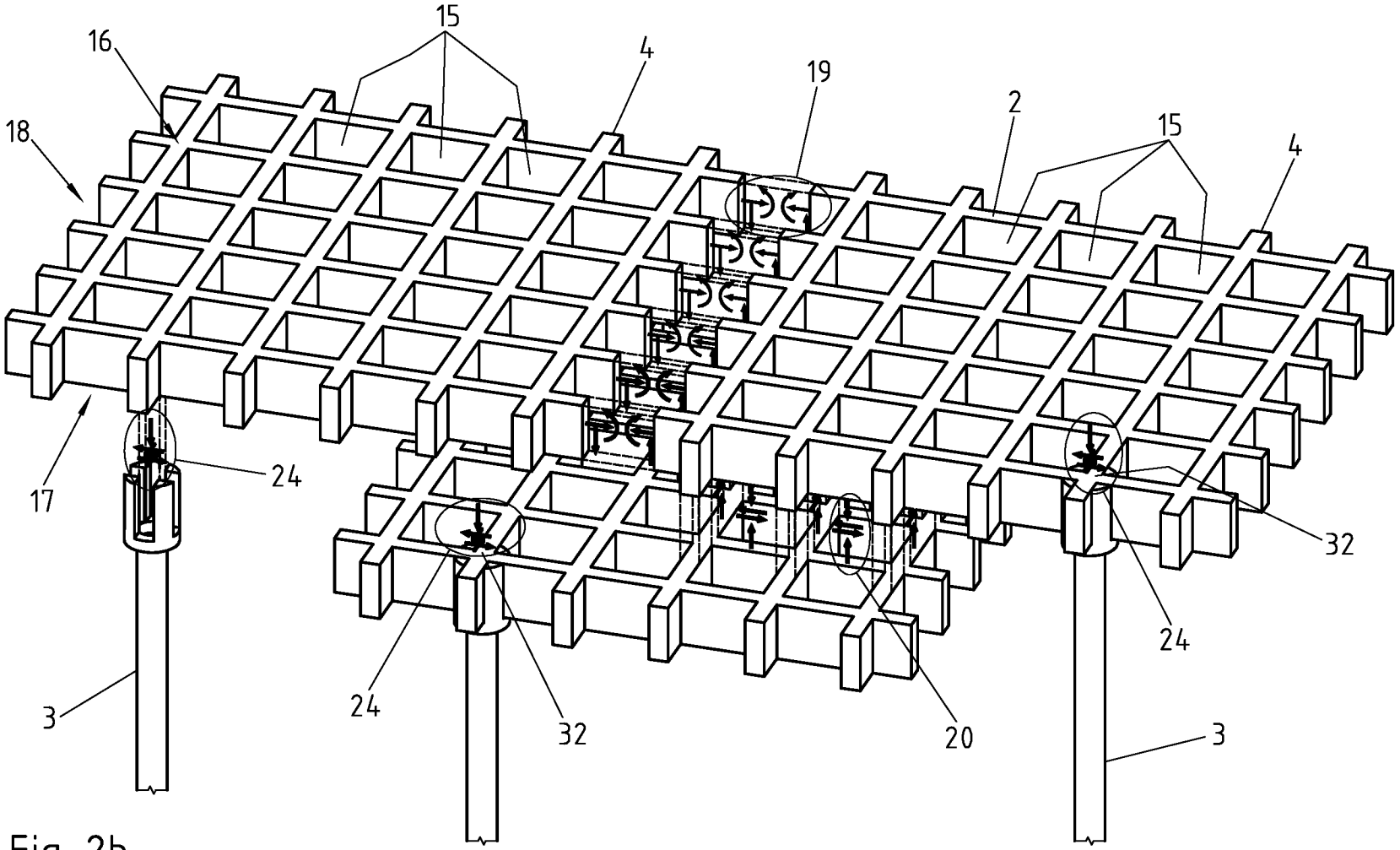

FIG. 2*b* represents an alternative to the embodiment represented on FIG. 2*a*. In this embodiment, the columns 7 (i.e. elongated load supports 3) are fastened with the slab 4 (i.e. flat load supports 2) at positions 32 between the openings 15 of said slab 4 (i.e. flat load supports 2).

Figure 2C:
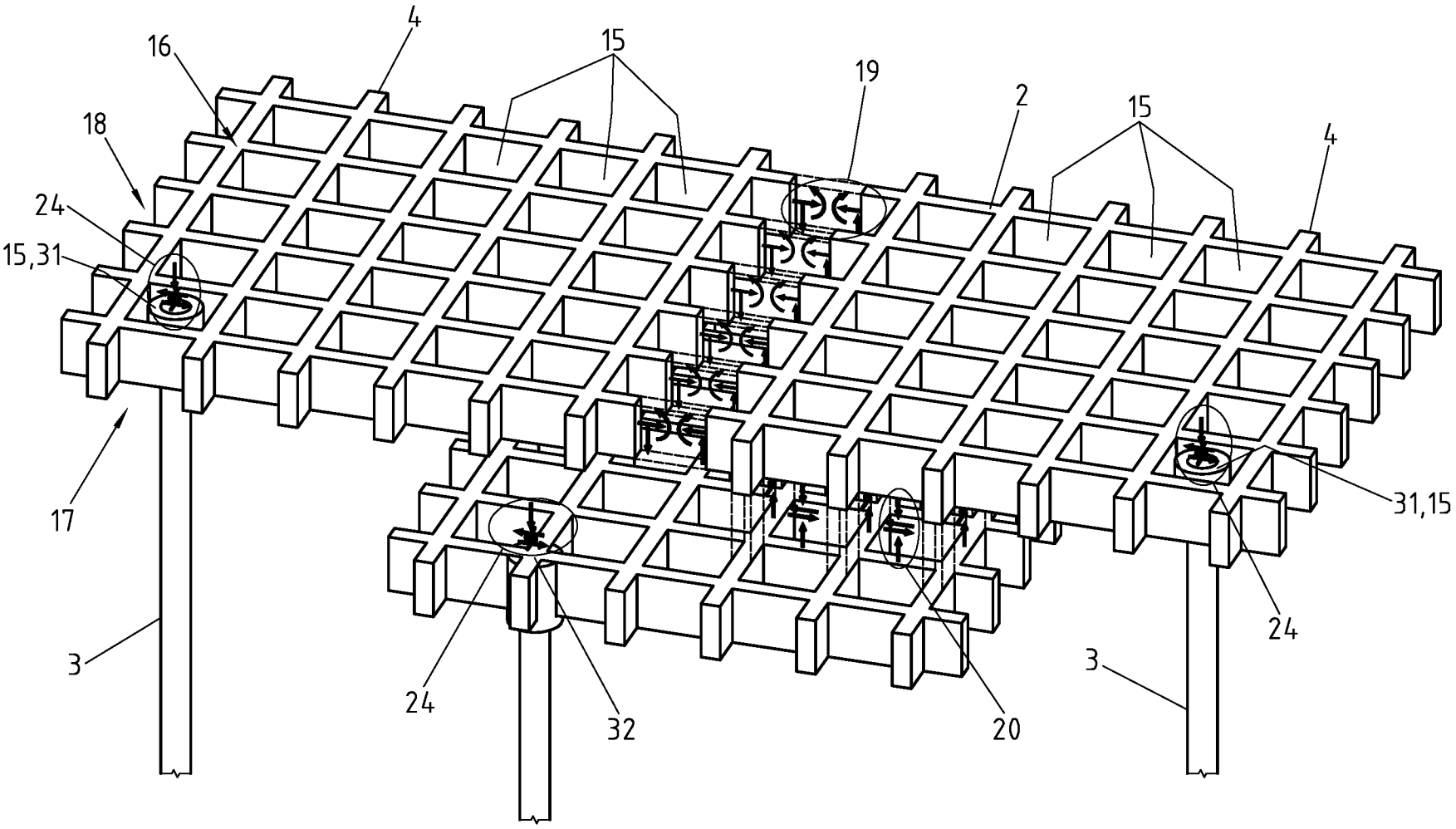

FIG. 2*c* represents an alternative to the embodiments represented on FIGS. 2*a* and *b*. In this embodiment, the columns 7 (i.e. elongated load supports 3) are fastened with the slab (i.e. flat load supports 2) at positions 31 corresponding to the openings 15 and at positions 32 between the openings 15 of said slab 4 (i.e. flat load supports 2).

Therefore, as illustrated on FIGS. 2*a-c*, in the present invention it is possible to fastened the elongated load support 3 with the flat load support 2 at any position 32 between the opening and at a position 31 corresponding to the opening 15.

Figure 3:
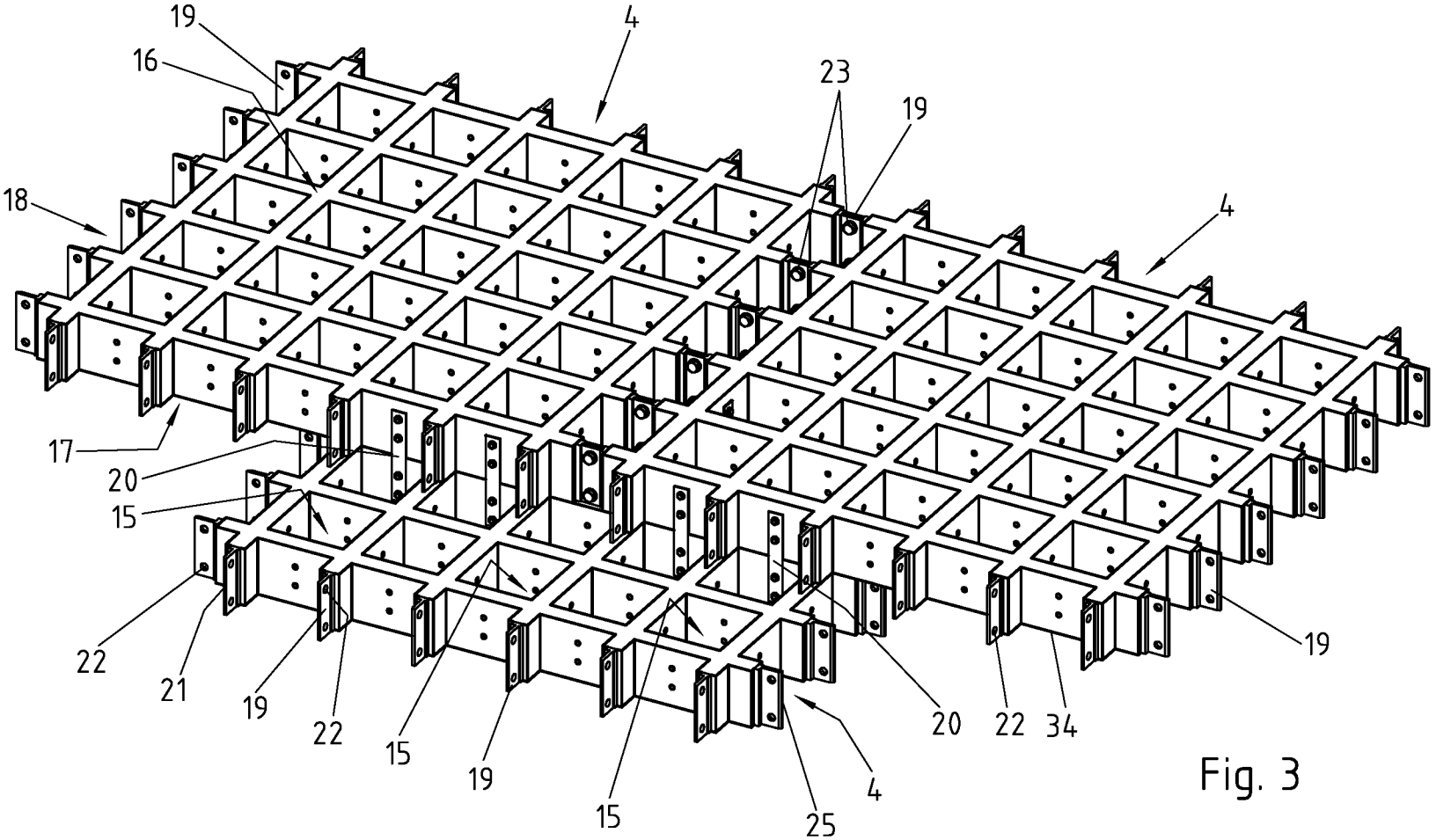
FIG. 3 illustrates a zoomed view of the flat load support represented in FIG. 1 with example of lateral and transversal connection means.

FIG. 3 represents the lateral connection means 19 and transversal connection means of the embodiment illustrated in FIG. 1. In this embodiment, each lateral connection means 19 comprises a plate 21 with two apertures 22 of a diameter that corresponds to that of bolts 23.

The device 1 further comprises fastening means 24 for fastening each column 7 with their respective openings 15 in a reversible manner.

Figure 4:
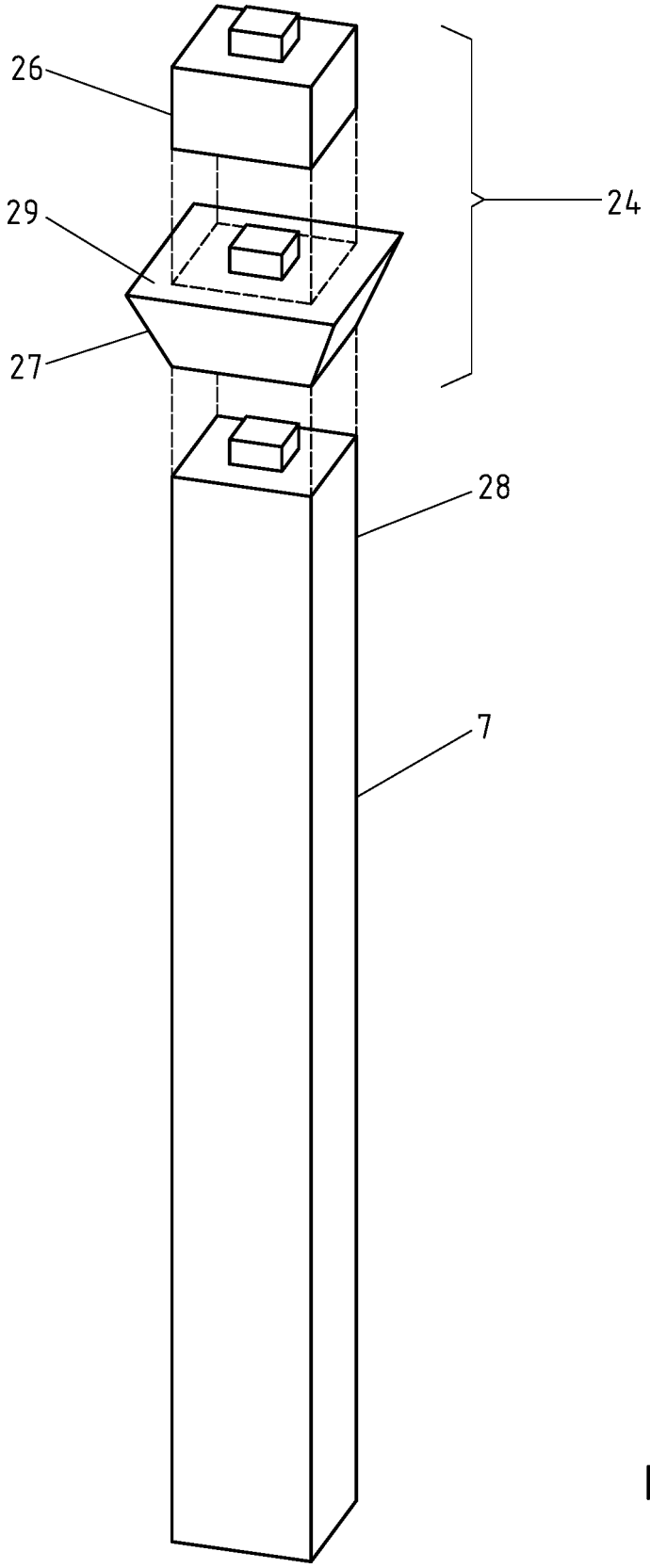
FIG. 4 illustrates the elongated load support of the device of FIG. 1 with an example of connector between flat load support and elongated load support.
Figure 5A:
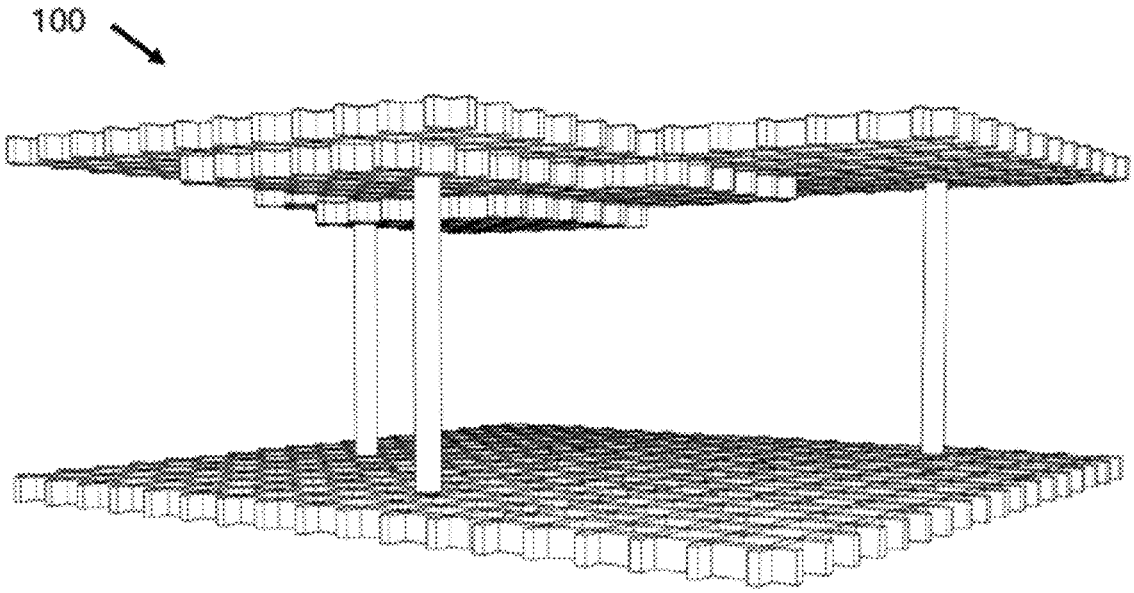
FIG. 5A illustrates an example first building which is disassembled and re-assembled into a second building.
Figure 5B:
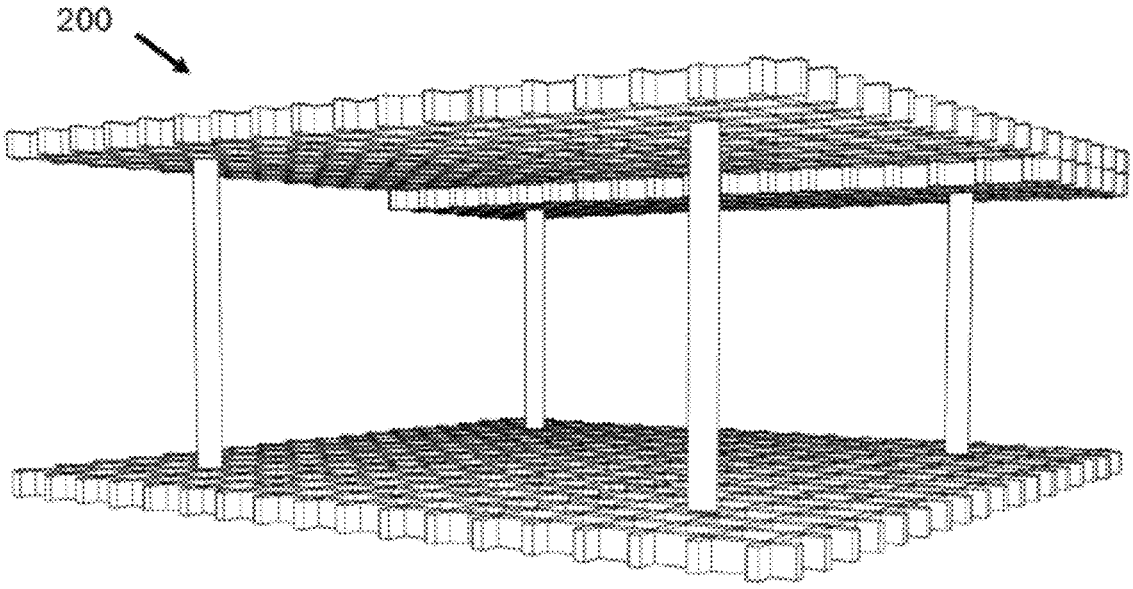
FIG. 5B illustrates the second building, after the first building of FIG. 5A has been disassembled and re-assembled into the second building.
Figure 6:
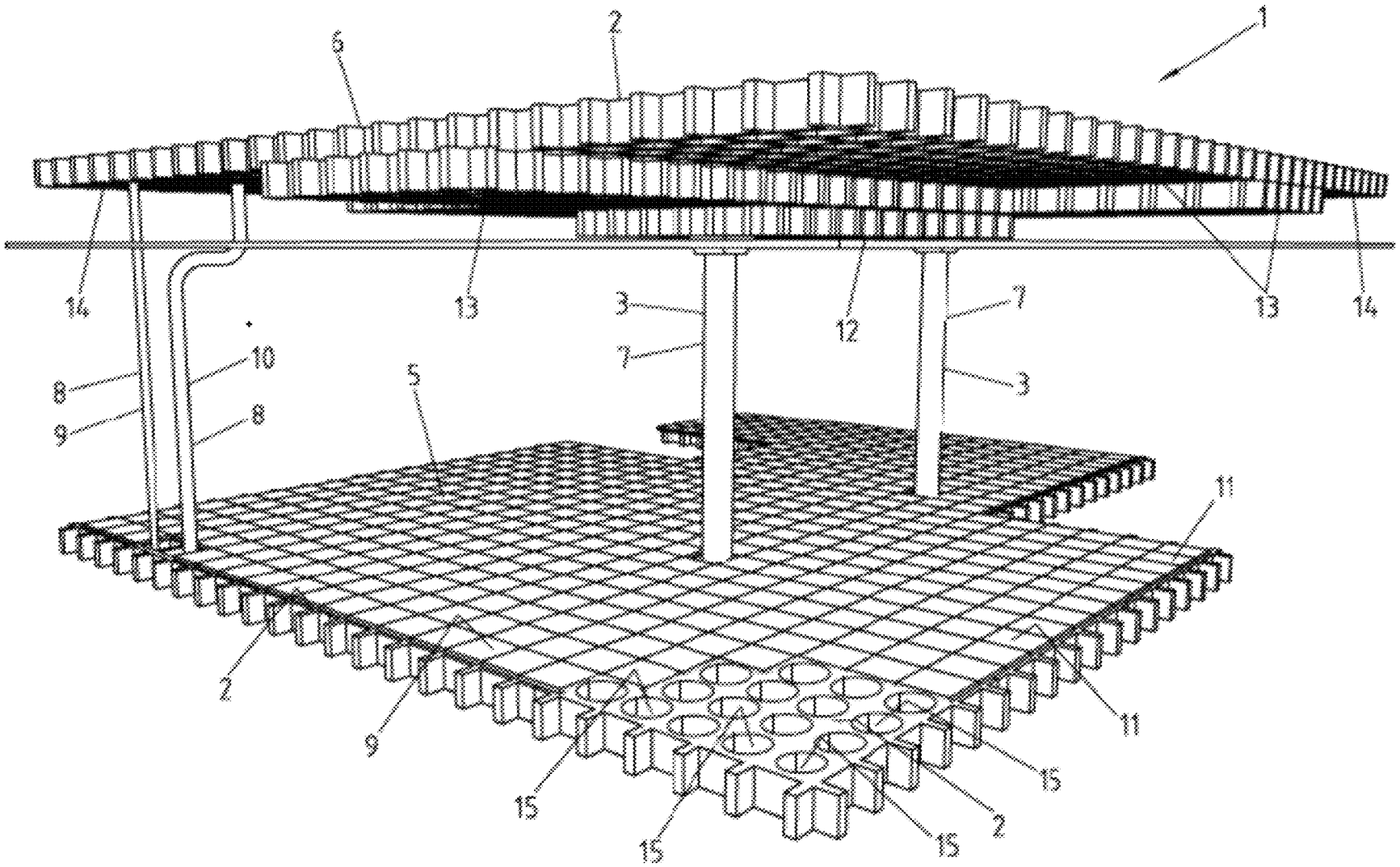
FIG. 6 illustrates an example embodiment of a device including circular openings.

FIG. 4 represents a general view of fastening means 24 for fastening an elongated load support 3 with an opening 15 of the flat load support 2.

For instance in the embodiment represented in FIG. 4 the fastening means 24 comprise a connector 25 made of two superimposed elements 26,27 fixed on the distal end 28 of the column 7, all assembled by a tenon mortise joints.

- the first element 26 is coupled with the distal end 28 of the column 7 via tenon mortise joint;
- the second element 27 is coupled to the first element 26 via tenon mortise joint.

The second element 27 is shaped to fit within the opening 15, i.e. the second element 27 is less large than the opening 15. In particular the height of the second element 27 corresponds to the thickness of the slab element 4, i.e. the height of the opening 15.

When the first element 26 is coupled with the second element 27, the portion of the surface out of the contacting surface between the first and second element defines a shoulder 29. The shoulder 29 is designed for contacting an edge 30 of the slab element when the first element is contacting the slab element 4 in order to fasten the column 7 with the slab. The edge 30 corresponds to a peripheral area surrounding the opening 15 on the second main face 17.

While the embodiments have been described in conjunction with a number of embodiments, it is evident that many alternatives, modifications and variations would be or are apparent to those of ordinary skill in the applicable arts. Accordingly, this disclosure is intended to embrace all such alternatives, modifications, equivalents and variations that are within the scope of this disclosure. This is for example particularly the case regarding the different apparatuses which can be used.

| Reference numbers | |
|---|---|
| 1 | Device |
| 2 | Flat load support |
| 3 | Elongated load support |

-continued

| Reference numbers | |
|---|---|
| 4 | Slab element |
| 5 | floor |
| 6 | ceiling |
| 7 | column |
| 8 | Service shaft |
| 9 | Water tube |
| 10 | Technical shaft |
| 11 | tile |
| 12 | First portion of the ceiling |
| 13 | Second portion of the ceiling |
| 14 | Third portion of the ceiling |
| 15 | opening |
| 16 | First main face |
| 17 | Second main face |
| 18 | Lateral face |
| 19 | Lateral connection means |
| 20 | Transversal connection means |
| 21 | plates |
| 22 | aperture |
| 23 | bolt |
| 24 | Fastening means |
| 25 | connector |
| 26 | First element |
| 27 | Second element |
| 28 | Distal end |
| 29 | shoulder |
| 30 | edge |
| 31 | position corresponding to an opening |
| 32 | position between the openings |

The invention claimed is:

1. A load bearing device for use in at least one of modular, reversible, and/or versatile building construction, the device comprising:

at least one flat load support comprising a first main face and a second main face opposed to the first main face, the first main face and the second main face connected by lateral faces, and a distance between the first main face and the second main face defining a thickness of the flat load support, wherein, the at least one flat load support includes a perforated slab element, the perforated slab element has a square shape, or a rectangular shape, the perforated slab element includes an array of adjacent transverse openings distributed evenly, each transverse opening has a square shape, a rectangular shape or a circular shape, and each of the adjacent transverse openings extends through the thickness of the at least one flat load support, thereby defining the transverse openings and sides separating adjacent transverse openings;

at least one elongated load support configured to couple with said flat load support, wherein, the at least one elongated load support is a column including at least one distal end configured to fasten with any of the adjacent transverse openings, and each of the adjacent transverse openings is arranged to receive one of the at least one distal end of the at least one elongated load support; and at least one reversible fastener arranged for fastening said flat load support with said elongated load support at any position corresponding to one of said adjacent transverse openings in a reversible manner, said positions between adjacent transverse openings comprising said sides separating adjacent transverse openings, wherein each flat load support comprises a reversible lateral connector on the lateral face to couple at least two flat load supports side by side in a reversible manner, and/or each flat load support comprises a reversible transversal connector for coupling two directly superimposed flat load supports in a reversible manner, and wherein said flat load support and said elongated load support are arranged for detachable assembly to provide the modular, reversible, and/or versatile building construction.

2. The device according to claim 1, wherein at least two of a stiffness and strength of the at least one flat load support, a number of elongated load supports fastened to the at least one flat load support, and a number of directly superimposed flat load supports, are tuned with one another.

3. The device according to claim 1, wherein each flat load support is configured to be directly superimposed on top of one another.

4. The device according to claim 3, wherein the at least one flat load support comprises at least two directly superimposed flat load supports.

5. The device according to claim 1, wherein said lateral faces are arranged to fasten with said elongated load support in a reversible manner.

6. The device according to claim 1, further comprising at least one connector for connecting the at least one elongated load support with the at least one flat load support at any position corresponding to one of said adjacent transverse openings and/or to any position between said openings, said positions between adjacent openings comprising said sides separating adjacent transverse openings.

7. The device according to claim 1, wherein the load bearing device comprises at least two substantially parallel flat load supports connected to the at least one elongated load support.

8. The device according to claim 1, wherein the adjacent transverse openings are distributed evenly on a network.

9. The device according to claim 1, further comprising at least one tile configured to cover at least one of the adjacent transverse openings.

10. A construction building comprising at least one device according to claim 1.

11. A method for constructing modular, reversible, and/or versatile buildings comprising a load bearing device, the method comprising:

providing the load bearing device according to claim 1;

assembling the least one flat load support and the least one elongated load support according to a first construction plan to provide a first building;

disassembling the first building by unfastening the at least one fastener that fastens said at least one flat load support and said elongated load support; and re-assembling at least some of said at least one flat load support(s) and at least some of said elongated load support(s) according to a second construction plan different from said first construction plan to provide a second building.

12. The method according to claim 11 further comprising:

repeating the assembling, disassembling and reassembling n times to build a «n» building according to a «n» construction plan.

13. The method according to claim 11, further comprising:

installing at least one tile on one of said openings;

removing or replacing or placing said tile to fit new layouts of the at least one elongated load support fastened to the at least one flat load support and/or to fit to a new service shaft; or removing said tile(s) during the disassembly of said first building, and re-installing said tile(s) during the re-assembly of the first building or the second building.

14. The method according to claim 12, further comprising:

installing at least one tile on one of said openings during the assembly of the first building;

removing said tile(s) without disassembling said first building; and re-installing said tiles in the first building to adapt to new layouts of the at least one elongated load support fastened to the at least one flat load support and/or to fit to a new service shaft.

15. The method according to claim 11, further comprising:

assembling at least two flat load supports on top of each other.

16. The method according to claim 11, wherein assembling the least one flat load support and the least one elongated load support includes assembling at least two elongated load supports.

17. The method according to claim 11, wherein assembling the at least one flat load support and the at least one elongated load support includes assembling at least three elongated load supports.

18. The method according to claim 11, further comprising:

assembling at least two flat load supports, either laterally or transversally, so that the adjacent transverse openings of connected flat load supports are aligned on a continuous grid of axes.

19. The device according to claim 1, further comprising at least two substantially parallel flat load supports connectable via reversible lateral connectors, wherein all of the adjacent transverse openings of laterally connected flat load supports remain aligned on a continuous grid of axes.

20. The device according to claim 1, wherein said perforated slab element includes an array of adjacent transverse openings having different shapes and different sizes, each opening having a common side with adjacent ones of the transverse openings.

21. The device of claim 1, wherein each transverse opening has the square shape or the rectangular shape.

22. The device of claim 1, wherein each transverse opening has the square shape or the circular shape.

23. The device of claim 1, wherein each transverse opening has the square shape.

* * * * *